US007285184B2

(12) United States Patent
Li et al.

(10) Patent No.: US 7,285,184 B2
(45) Date of Patent: Oct. 23, 2007

(54) CELLULOSIC FIBER PULP AND HIGHLY POROUS PAPER PRODUCTS PRODUCED THEREFROM

(75) Inventors: Jian Li, Richmond Hill, GA (US); Steve F. Boller, Richmond Hill, GA (US)

(73) Assignee: Rayonier, Inc., Jesup, GA (US)

( * ) Notice: Subject to any disclaimer, the term of this patent is extended or adjusted under 35 U.S.C. 154(b) by 242 days.

(21) Appl. No.: 10/419,398

(22) Filed: Apr. 21, 2003

(65) Prior Publication Data

US 2004/0206464 A1 Oct. 21, 2004

(51) Int. Cl.

| | |
|---|---|
| ***D21H 19/34*** | (2006.01) |
| ***D21H 11/18*** | (2006.01) |
| ***D21H 17/25*** | (2006.01) |
| ***D21C 3/02*** | (2006.01) |
| ***D21C 3/04*** | (2006.01) |

(52) U.S. Cl. ..... 162/163; 162/76; 162/90; 162/157.6; 162/175; 162/182; 162/183

(58) Field of Classification Search ..... 162/90, 162/125, 134–137, 72, 157.1, 157.6, 175–177, 162/14, 76, 163, 182, 183; 106/163.01
See application file for complete search history.

(56) References Cited

U.S. PATENT DOCUMENTS

| | | | | |
|---|---|---|---|---|
| 1,280,400 | A | | 10/1918 | Clapp |
| 2,528,349 | A | | 10/1950 | Farber |
| 3,148,106 | A | * | 9/1964 | Mitchell et al. ..... 162/90 |
| 3,620,912 | A | * | 11/1971 | Beelik et al. ..... 162/90 |
| 3,988,198 | A | | 10/1976 | Wilson et al. |
| 4,075,028 | A | | 2/1978 | Amosov et al. |
| 4,274,914 | A | | 6/1981 | Keith et al. |
| 4,455,237 | A | | 6/1984 | Kinsley |
| 5,338,406 | A | | 8/1994 | Smith |
| 5,348,621 | A | | 9/1994 | Rudy |
| 5,589,033 | A | | 12/1996 | Tikka et al. |
| 5,810,972 | A | * | 9/1998 | Reinheimer et al. ..... 162/175 |
| 5,858,021 | A | * | 1/1999 | Sun et al. ..... 8/125 |
| 5,858,172 | A | | 1/1999 | Sears et al. |
| 6,171,441 | B1 | * | 1/2001 | Phillips et al. ..... 162/9 |
| 6,319,361 | B1 | | 11/2001 | Smith et al. |
| 6,488,809 | B1 | | 12/2002 | Phillips et al. |
| 6,902,649 | B1 | * | 6/2005 | Satyavolu et al. ..... 162/91 |
| 2002/0084045 | A1 | | 7/2002 | Collias et al. |
| 2004/0020854 | A1 | * | 2/2004 | Ali et al. ..... 210/652 |

* cited by examiner

*Primary Examiner*—Eric Hug
(74) *Attorney, Agent, or Firm*—Alston & Bird LLP

(57) ABSTRACT

A cellulosic pulp, method of producing the pulp, and associated paper product produced therefrom produced by providing mercerized cellulosic fibers and depositing a hemicellulose coating upon the mercerized fibers. The hemicellulose is deposited upon the fibers by combining a hemicaustic solution with the mercerized fibers in the presence of an acidifying agent. When formed into a paper sheet, the invented fibers form a highly porous paper having improved strength and reduced dusting.

9 Claims, 4 Drawing Sheets

CELLULOSIC FIBER PULP AND HIGHLY POROUS PAPER PRODUCTS PRODUCED THEREFROM

FIELD OF THE INVENTION

This invention relates to the treatment of cellulosic fibers. More particularly, the invention relates to a method of mercerizing cellulosic fibers and subsequently depositing a coating upon the surface of the mercerized fibers.

BACKGROUND OF THE INVENTION

Highly porous cellulosic paper products have a variety of personal, commercial, and industrial uses. For instance, the porosity of the paper makes the paper useful as a filter for the purification of fluid streams. Common examples of such filters are conventional air filters, water filters, and oil filters.

Cellulose fibers that form the basis of the highly porous papers are specially treated in order to stiffen the fibers and give the individual fibers a rod shape, in contrast to the ribbon-shaped fibers used in traditional paper making. The stiffened, rod-shaped fibers allow for the production of low density paper products that have acceptable structural properties.

One method of stiffening the cellulose fibers is "mercerization", a method of treating the cellulosic fibers with concentrated caustic solutions in order to alter the morphology of the fiber structure by changing the crystallinity of the cellulose fiber from cellulose I to cellulose II. Mercerization may be accomplished by using a cold caustic treatment process. Cold caustic treatments are generally performed by mixing a low consistency cellulose slurry with an alkaline solution, typically a sodium hydroxide solution, and allowing the mixture to steep, or react, for a suitable amount of time. Mercerization transforms the ribbon-like cross section of the raw cellulosic fibers into a round shape, thereby increasing the stiffness of the fibers. The steeped cellulose fiber is subsequently washed to remove the caustic solution and then may be subjected to downstream processing.

Filter paper is typically produced by depositing mercerized fiber pulp upon a web, as in ordinary paper production, under conditions that result in the desired porosity of finished paper product.

Prior to use, sheets of filter paper are often folded or crimped in order to increase the available surface area of the filter incident to the volume of fluid being filtered. For instance, filter papers are commonly crimped in alternating directions along the length of the paper in order to form the paper into an accordion-shaped filter, which is then disposed within a filter housing.

Because the filter paper is constructed of a low-density arrangement of stiff cellulose fibers, folding and crimping of the paper tends to cause significant dusting. Dusting is the unintended separation of cellulose particles from a paper material upon manipulation of the paper. Dusting is particularly problematic during filter formation due to the large number of crimps and bends made during formation of a filter and because the stiffened fibers of the mercerized filter paper tend to flake off easily when the paper is manipulated.

Previous attempts to minimize dusting have involved application of adhesive compounds to the finished filter paper in order to fix the cellulose fibers in place. Although application of adhesive to the paper does reduce dusting, the adhesive tends to adversely reduce the porosity of the filter. Thus, there remains a need in the art to develop a method to reduce dusting in highly porous cellulosic paper products without significantly reducing the porosity of the filter paper.

BRIEF SUMMARY OF THE INVENTION

The present invention is a cellulosic pulp and method of producing a cellulosic pulp that exhibits improved physical properties and that is well suited for the preparation of highly porous paper products. The invention further includes highly porous paper products formed from the improved cellulosic pulp.

The improved pulp is produced by mercerizing cellulosic fibers and, subsequently, depositing hemicellulose onto the surfaces of the individual fibers of the pulp. The hemicellulose may be provided as a raw additive, or may advantageously be obtained by the acidification of a hemicaustic stream.

The cellulosic fibers are mercerized as previously known in the art of papermaking. The mercerization of the pulp imparts high strength and rigidity to the fibers by changing the crystallinity of the fibers and by giving the fiber a rod-shape.

Hemicellulose is deposited on the mercerized fibers under conditions that promote the ready deposition of hemicellulose upon the surface of the fibers but that do not promote the ready infiltration of hemicellulose into the body of the fibers. Hemicellulose is preferably deposited upon the fibers by acidifying a hemicaustic solution prior to or subsequent to the combination of the hemicaustic solution with the mercerized pulp, thereby causing the hemicellulose to come out of solution and deposit upon the pulp fibers. The removal of hemicellulose from hemicaustic solution occurs below pH 13, and preferably between a pH of about 2 and about 9.

According to one aspect of the invention, a pulp source of mercerized cellulosic fiber is provided, and the pulp is slurried with a caustic solution containing dissolved hemicellulose, defined as hemicaustic solution. An acidifying agent is applied to the pulp suspension containing the hemicaustic solution and, upon depression of the solution pH, hemicellulose is released from the hemicaustic solution and deposited upon the pulp fibers.

Alternatively, the hemicaustic solution may first be supersaturated with hemicellulose, either by depressing the pH of the hemicaustic solution or by other means, and the pulp may afterwards be slurried with the supersaturated hemicaustic solution, resulting in deposition of hemicellulose upon the surface of the fibers.

Alternatively, the pulp may first be slurried with an acidic solution, and the hemicaustic solution may afterwards be combined with the acidic pulp slurry, resulting in the deposition of hemicellulose from the hemicaustic solution to the surface of the pulp fibers.

Alternatively, the pulp may be combined with a caustic solution and a concentrated hemicellulose material such that the hemicellulose supersaturates the caustic solution, resulting in the deposition of hemicellulose from the caustic solution to the surface of the pulp fibers. The concentrated hemicellulose material may be a dried or slurried hemicellulose material.

According to another aspect of the invention, a source of cellulosic fibers is provided and slurried with a caustic solution in order to remove hemicellulose from the pulp fibers. To remove hemicellulose from the body of the pulp fibers, the pulp is steeped in caustic solution under concentrations, temperatures, and time known in the art to result in the mercerization of the pulp fibers and reduction of hemicellulose content of the fibers. The pulp is removed from the caustic solution and washed. The used caustic solution contains hemicellulose and is therefore designated as a hemicaustic stream. The pulp may be subjected to additional processes, such as bleaching, screening, and oxidation/extraction processes. The hemicaustic stream is subsequently recombined with the processed pulp in the presence of an acidifying agent, which results in the deposition of hemicellulose on the pulp fibers. This aspect of the invention has the obvious advantage of extracting hemicellulose from the body of the pulp fibers and subsequently depositing the hemicellulose upon the outer surface of the fibers, without need for any external source of hemicellulose.

According to another aspect of the invention, hemicellulose material is deposited upon mercerized cellulose fibers, as described above, and the pulp of the fibers is formed into a highly porous paper sheet. The hemicellulose acts as a bonding agent to bond the cellulose fibers to one another during paper formation. The paper sheet exhibits superior rigidity in comparison to papers formed from non-mercerized fibers, and exhibits improved inter-fiber bonding compared with highly porous mercerized papers in which the fibers have not been coated with hemicellulose.

Because of the improved inter-fiber bonding, bending or physical manipulation of the paper results in reduced dusting compared to similarly porous paper products of the art. The improved inter-fiber bonding is gained without the appreciable loss in porosity associated with adhesive coatings of the past because the hemicellulose is deposited upon the surfaces of the individual pulp fibers, rather than being applied as an adhesive layer upon a previously formed paper substrate. In addition, the hemicellulose deposited upon the fibers does not adversely affect the flexibility of the resulting paper substrate.

BRIEF DESCRIPTION OF THE SEVERAL VIEWS OF THE DRAWINGS

Figure 1:
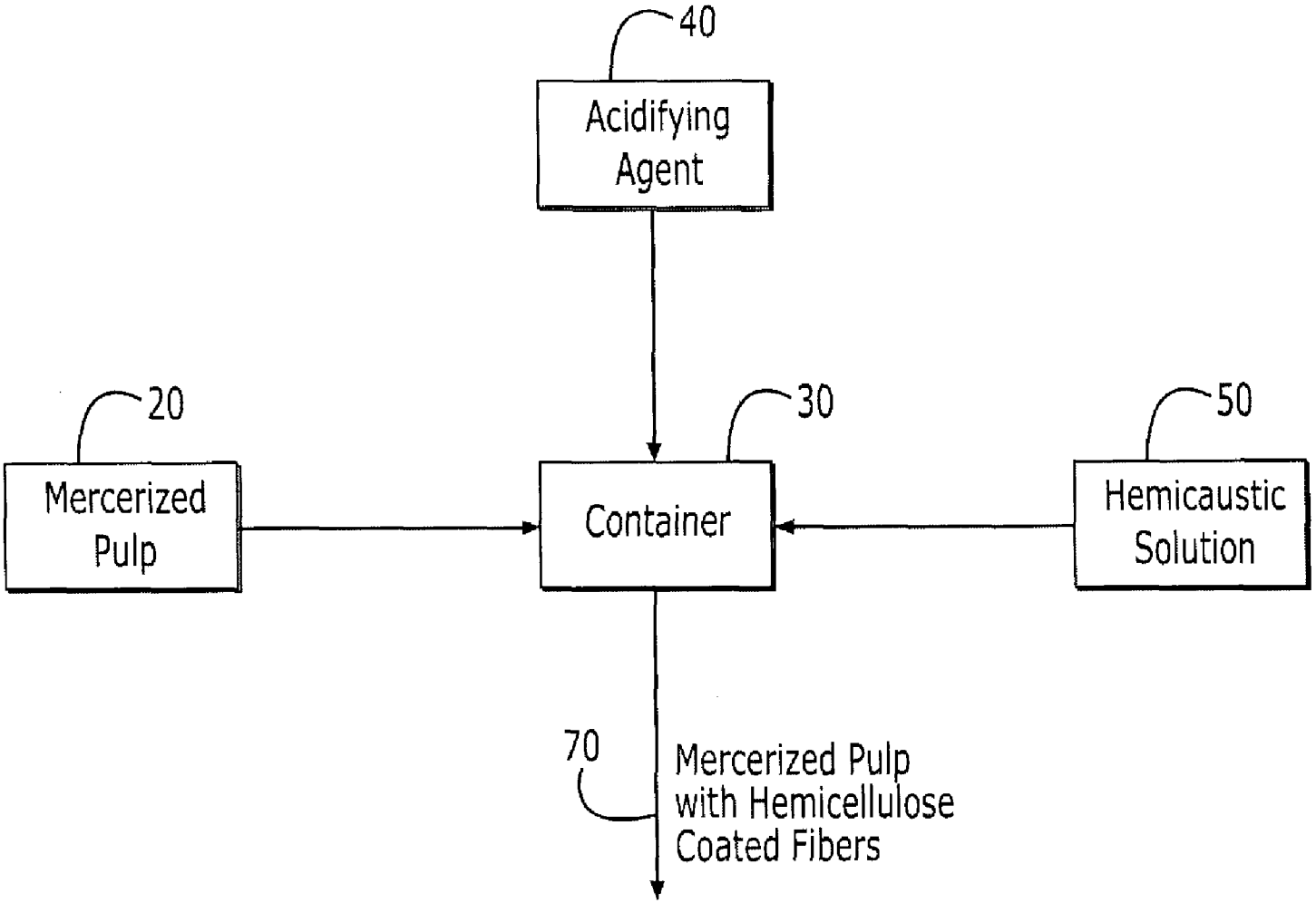
Figure 2:
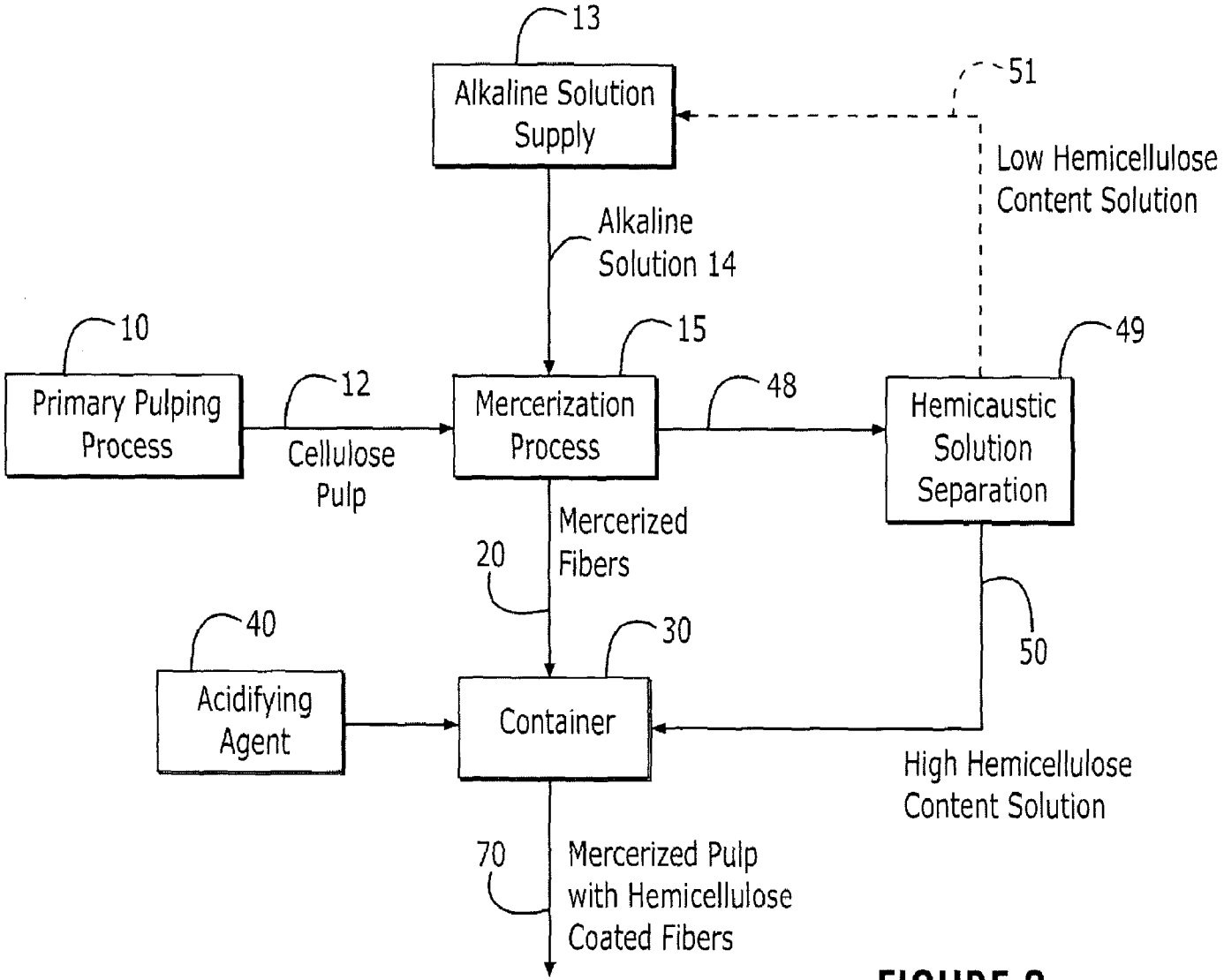
Figure 3:
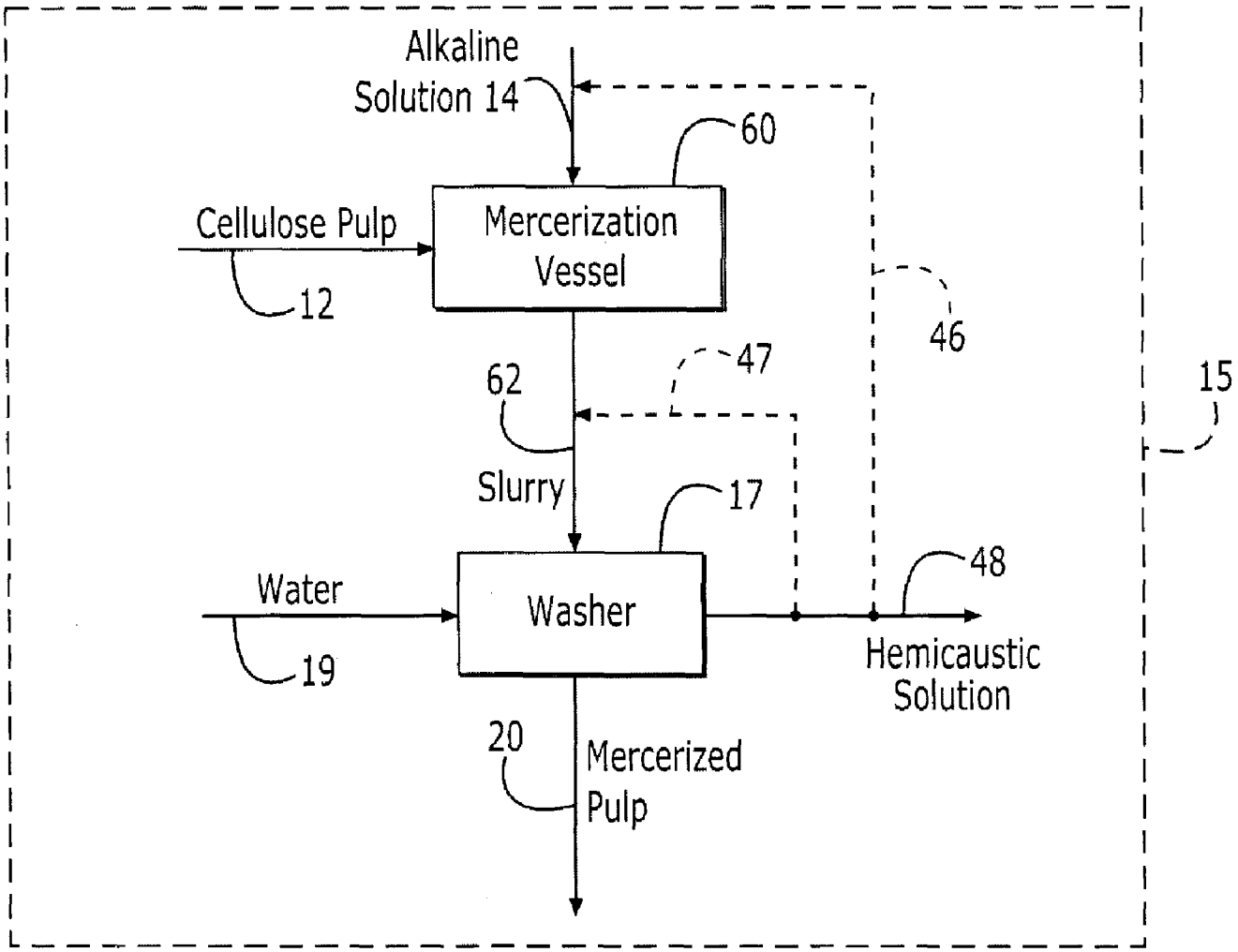
Figure 4:
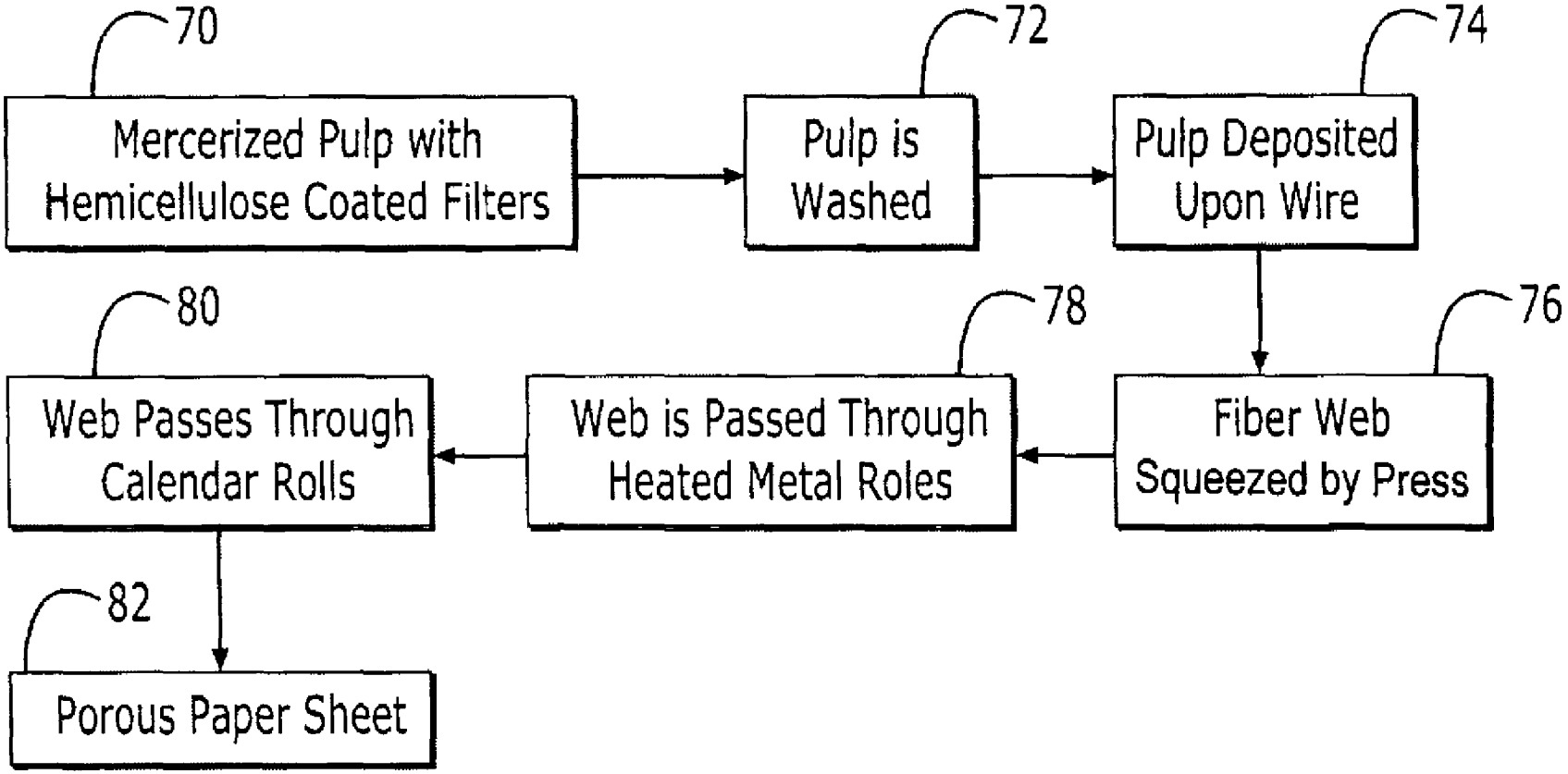

Having thus described the invention in general terms, reference will now be made to the accompanying drawings, which are not necessarily drawn to scale, and wherein:

FIG. 1 is a schematic representation of a method for producing a cellulose fiber pulp in accordance with an embodiment of the invention;

FIG. 2 is a schematic representation of a method for producing a cellulose fiber pulp in accordance with another embodiment of the invention;

FIG. 3 is a schematic representation of a particular method of mercerizing a cellulose fiber in accordance with another embodiment of the invention; and FIG. 4 is a schematic representation of a method of paper production using the invented cellulose fiber in accordance with another embodiment of the invention.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring to FIG. 1, according to one embodiment of the invention, hemicellulose material is deposited upon the surface of mercerized cellulose fibers by combining a mercerized cellulose pulp 20, an acidifying agent 40, and a hemicaustic solution 50 under conditions favorable for hemicellulose deposition. Favorable hemicellulose deposition occurs by maintaining the pulp 20, acidifying agent 40, and hemicaustic 50 in a container 30, preferably a mixing container, for a time sufficient to deposit an effective amount of hemicellulose upon the cellulose fibers 70.

The mercerized cellulosic pulp 20 is generally described in relation to cellulosic fibers derived from wood pulp. However, the invention may be used in conjunction with any cellulosic fiber derived from any source. Exemplary cellulosic fibers include, but are not limited to, those derived from wood, such as wood pulp, as well as non-woody fibers from cotton, from straws and grasses, such as rice and esparto, from canes and reeds, such as bagasse, from bamboos, from stalks with bast fibers, such as jute, flax, kenaf, cannabis, linen and ramie, and from leaf fibers, such as abaca and sisal. It is also possible to use mixtures of one or more cellulosic fibers.

Mercerized wood fibers suitable for use in the present invention may be derived from either a softwood pulp source or hardwood pulp source or mixtures thereof. Exemplary softwood pulp sources include trees such as various pines (Slash pine, Loblolly pine, White pine, Caribbean pine), Western hemlock, various spruces, (e.g., Sitka Spruce), Douglas fir and/or mixtures of same. Exemplary hardwood pulp sources include trees such as sweet gum, black gum, maple, oak, eucalyptus, poplar, beech, and aspen or mixtures thereof.

As used herein, the term "pulp" simply refers to a mass or agglomeration of cellulose fibers. The pulp may be supplied in a dry form or as a slurry. As used herein, the term "fiber" or "fibrous" is meant to refer to a particulate material wherein the length to diameter ratio of such particulate material is greater than about 10. In advantageous embodiments, the cellulosic fibers are characterized by an average length, e.g., a WAFL length, between about 0.1 to 6 mm. In advantageous aspects of the invention the average fiber length is between about 0.8 and 4 mm.

As used herein, the term "mercerized" refers to cellulose fibers that have been processed under conditions in which crystallinity of the raw cellulose fiber is altered. Mercerization results in cellulose fibers having a rigid rod-like shape in contrast to the ribbon-like shape of non-mercerized cellulose fibers. Mercerized cellulose fibers are commercially available as Porosanier™ pulp, available from Rayonier Inc., Jesup, Ga. Porosanier™ pulp is a fully bleached southern softwood pulp with very high porosity, e.g., a Frazier Porosity value above about 120 $cm^3/(cm^2 \cdot s)$.

The acidifying agent 40 is a substance capable of reducing the pH value of a caustic solution to below 13. Examples of acidifying agents are inorganic acids such as sulfuric, nitric, phosphoric and hydrochloric, and organic acids such as acetic, formic, and carbonic acids. Other inorganic and organic acids include but are not limited to solid mono-, oligo- and polycarboxylic acids, such as citric acid, tartaric acid and succinic acid, polycarboxylic acids, such as polyacrylic acid, and also such acids as malonic acid, adipic acid, maleic acid, fumaric acid, oxalic acid, boric acid or amidosulfonic acid and mixtures of the acids mentioned. Acidic salts, such as hydrogen sulfates or carbonates, may also be used as acidifying agents, in which case the only important requirement again is to ensure that the pH conditions are maintained and, if provided as a solid, the acidifying agent should rapidly dissolve in aqueous solutions.

The hemicaustic solution 50 is an alkaline solution that contains dissolved hemicellulose. The hemicaustic solution 50 may be any aqueous alkaline solution or mixture of alkaline solutions, but is preferably a solution of caustic soda (NaOH). The hemicaustic solution 50 contains hemicellulose in solution and is preferably saturated or nearly saturated with hemicellulose. In order to maintain large concentrations of hemicellulose in solution, the pH of the hemicaustic solution 50 must be above about 9. Therefore, hemicaustic solution 50 preferably has a pH above 9 and more preferably above 13. An exemplary hemicaustic solution contains greater than 1 wt % of caustic soda and above 0.2 wt % hemicellulose.

The hemicaustic solution 50 is preferably supplied directly from a pulping operation, and may advantageously be supplied from the pulping processes used to prepare the mercerized pulp 20. Further, the hemicaustic stream from the pulping process may be concentrated through use of filtration or other separation techniques in order to increase the amount of dissolved hemicellulose within the hemicaustic solution 50 prior to recombination with the mercerized pulp.

The mercerized cellulose 20, acidifying agent 40, and hemicaustic solution 50 may be combined in any order. For instance, the mercerized cellulose 20 may be combined with the acidifying agent 40, followed by addition of the hemicaustic solution 50. Alternatively, the mercerized cellulose 20 may be combined with the hemicaustic solution 50, followed by addition of the acidifying agent 40. Alternatively, the hemicaustic solution 50 may be combined with the acidifying agent 40, followed by addition of the mercerized cellulose 20.

Whichever order of combination is used, it is important that the cellulose 20 not remain in un-acidified hemicaustic solution 50 for an extended period of time. If the cellulose 20 fibers are maintained in a hemicaustic solution, the dissolved hemicellulose will undesirably be carried into the body of the cellulose fibers by the caustic solution. Therefore, the acidifying agent 40 is preferably combined with the hemicaustic solution 50 prior to or shortly after combination of the mercerized cellulose 20 with the hemicaustic cellulose 20 so that the hemicellulose is deposited onto the surface of the fibers rather than carried into the body of the fibers.

Deposition of the hemicellulose upon the surface of the fibers may occur under a wide variety of temperature conditions, preferably between room temperature and about 100° C. The time needed for complete deposition is dependent upon the degree of mixing. For instance, if the pulp and acidified hemicellulose solution are processed through a shear mixer, the deposition may only take a few seconds. In a stirred tank or agitated vessel, the complete deposition may take several minutes to several hours.

It is to be understood that the invention is broadly applicable. The extent to which the hemicellulose coating is deposited upon the pulp fibers will depend upon such factors as the hemicaustic concentration, the pulp consistency, the relative amounts of pulp and hemicaustic solution, the temperatures involved, the time that the pulp and hemicellulose are allowed to dwell, the degree of pH depression by the acid, and the time delay (if any) between exposure of the pulp to the hemicaustic and pH depression with the acid.

In general, the hemicaustic solution, pulp, and acid are mixed in amounts and proportions in order to achieve about 0.1 wt % to about 10 wt % hemicellulose coating per dry weight of pulp fiber. By way of example, a 100 g dry pulp sample supplied in a slurry at 2 wt % to 50 wt % consistency is preferably combined with a hemicaustic solution having a hemicellulose content between about 0.2 wt % and 15 wt %, and a total hemicellulose content of between 0.2 g and 20 g of hemicellulose per 100 g wt %. The acid is supplied in an amount sufficient to reduce the pH of the hemicaustic solution below about 9.

The hemicellulose is deposited onto the surface of the cellulose fibers in the form of a coating. The coating is deposited in an amount effective to provide inter-fiber bonding between the fibers when the fibers are eventually formed into a paper product. The contemplated effective amount of hemicellulose coating is about 0.1 wt % to 10 wt % of coated hemicellulose per dry weight of cellulose fiber, and preferably about 0.5 wt % to 5 wt % of coated hemicellulose per dry weight of cellulose fiber. By way of comparison, uncoated mercerized fibers contain about 1 wt % to about 3 wt % hemicellulose. However, the majority of hemicellulose is contained inside the body of the uncoated mercerized fibers, and the uncoated fibers do not have an appreciable amount of hemicellulose upon the surface of the fibers.

Referring to FIG. 2, according to another embodiment of the invention, the hemicaustic solution 50 is obtained as a concentrated portion of the hemicaustic product of a mercerizing process used to produce the mercerized fibers 20.

Cellulose pulp 12 is produced using a primary pulping process 10 as known in the art. Exemplary wood pulping operations generally entail a series of steps, such as digestion, deknotting and the like, that separate the pulp into individual fibers and remove impurities from the pulp. The most common wood pulping operation 10 is the kraft pulping process. However, chemical pulping operations such as, but not limited to, sulfite pulping operations, and organic solvent pulping operations, may also be used.

The primary wood pulping process 10 begins by introducing cellulosic raw material, i.e. wood chips, into a digestion process which cooks the cellulose for a period of time under sufficient heat and pressure to separate the fibers used to produce pulp using conventional chemical pulping charges, temperatures and cooking times known in the art of pulping. Following digestion, the cellulose fibers are washed, deknotted, and washed again.

The primary pulping process 10 may include a bleaching process, or the cellulose may be bleached after the mercerizing process 15. Any bleaching process known in the art may be suitable for use in the present invention. The bleaching operation generally includes a series of oxidation and extraction steps intended to remove lignin from the wood pulp. The oxidation and extraction steps may be performed using any equipment, processes and materials known in the art of wood pulp bleaching.

After cellulose pulp 12 is obtained from the primary pulping process 10 as described above, the pulp 12 is combined with an alkaline solution 14 to begin a mercerization process 15.

There are a variety of mercerization processes capable of changing the crystallinity of the cellulose pulp 12 fibers and of making the cellulose fibers more rigid. Mercerization may be accomplished with a variety of different alkali metal hydroxides, such as NaOH, LiOH, and KOH. Tetramethylammonium hydroxide can also be used. According to one embodiment of the invention, a cold caustic treatment process is used to mercerize the fibers.

Referring to FIG. 3, in a cold caustic mercerizing process, the cellulosic fibers are generally supplied as pulp 12 from a primary pulping process in the form of a cellulose wood pulp slurry having a particular consistency, which is then combined with an alkaline, or caustic solution 14 sometimes referred to as the steeping liquor. "Consistency" refers to the concentration of the cellulosic fibers present in the cellulose slurry. The cellulose slurry 12 is preferably introduced with a consistency of between about 2 wt % and about 50 wt %.

The alkaline solution 14 generally includes a caustic compound, i.e. a compound capable of providing a pH of above 7, dispersed in water. The caustic compound is typically formed from at least one alkali metal salt. Suitable alkali metal salts include, but are not limited to, sodium hydroxide, lithium hydroxide, potassium hydroxide and mixtures thereof. In an alternative embodiment, tetramethyl ammonium hydroxide may be employed as the caustic compound. The concentration of caustic in the alkali solution 14 typically ranges from about 3 wt % to about 50 wt %. In one beneficial embodiment, the concentration of the caustic compound in the alkaline solution 14 is at or above 25 wt %, and exhibits a pH above 12 and typically near 14. Sufficient alkali solution 14 is combined with the cellulose pulp 12 to produce an alkaline cellulose slurry containing 2 wt % to 20 wt % caustic compound, for example 16 wt % caustic compound. The temperature of the alkali solution 14 is preferably from about 15° C. to about 40° C., and a separate chiller may be used, if needed, to cool the alkali solution 14 prior to combination with the cellulose pulp.

After combination, the alkaline solution 14 and cellulose pulp 12 are well mixed within a mercerization reaction vessel 60, such as an extraction vessel, for a sufficient amount of time to diffuse the hemicellulose out of the cellulosic fibers and into the alkaline solution 14. The mercerization process occurs rapidly upon first contact between the cellulose pulp and the alkali solution 14. Substantially all of the hemicellulose is removed from the fibers after only a few seconds in a thoroughly mixed reaction vessel. The mercerization process may occur prior to or subsequent to any bleaching process steps without adversely affecting the quality of mercerization.

The mercerization is typically conducted at comparatively low temperatures, as known in the art. For example, cold caustic treatments are generally carried out at a temperature less than about 50° C., advantageously at a temperature less than 40° C., such as a temperature between about 20° C. and about 40° C. In one beneficial embodiment, the cold caustic treatment may be conducted at a temperature of about 30° C.

The alkaline cellulose slurry is allowed to steep or react within the mercerization vessel 60 for a sufficient amount of time to diffuse an effective amount of the hemicellulose out of the cellulosic fibers and into the alkaline solution. The alkaline cellulose slurry may steep or react for exemplary dwell times up to 4 hours. In beneficial embodiments, the alkaline cellulose slurry is allowed to steep or react for a time sufficient to remove up to 100% of the hemicellulose initially present within the cellulose fibers. Consequently, the treated cellulose fibers within the treated cellulosic slurry exiting the mercerization vessel 60 generally contains no more than 10% hemicellulose, while the hemicaustic solution of the slurry 62 exiting the mercerization vessel 60 generally contains from about 0.5 to 7 wt % hemicellulose.

The treated cellulose slurry is transported from the mercerization vessel 60 to at least one washer 17, to separate the spent alkali solution containing the dissolved hemicellulose from the treated cellulosic fibers. The washer 17 may be any suitable wet process by which to extract the spent steeping liquor and hemicellulose from the treated cellulose slurry using water 19. Exemplary washers 17 for use in the present invention include, but are not limited to horizontal belt washers, rotary drum washers, vacuum filters, wash presses, compaction baffle (CB) filters, atmospheric diffusers and pressure diffusers.

The spent wash water stream exiting the treated cellulose washer 17, commonly referred to as the hemicaustic stream 48, generally includes hemicellulose, unreacted caustic compound from the steeping liquor, and water. The hemicaustic stream 48 exiting the washer 17 typically includes from about 0.5 to 7 wt % of hemicellulose, and up to 20 wt % of caustic compound, with the remainder being water and any optional additives that may have been included in either the alkali solution 13 or wash water 19. The hemicaustic stream typically exhibits a pH near 14. If necessary, a portion 47 of the hemicaustic stream may be recycled to the treated cellulose slurry stream 62 entering the washer in order to adjust the consistency of the treated cellulose slurry stream 62. Also, if the alkaline solution 14 is a strong caustic solution, the alkaline solution 14 may favorably be diluted by recycling a portion 46 of the hemicaustic stream 48 to the alkaline solution stream 14.

Referring again to FIG. 2, the hemicaustic stream 48 from the mercerization process is transferred to a solution separation apparatus 49 in order to separate the hemicaustic stream into a high concentration hemicellulose stream 50 and a low concentration hemicellulose stream 51. The low concentration hemicellulose stream 51 is optionally recycled to the alkaline solution 13 supply to the mercerization process 15. The high concentration hemicellulose stream 50 is combined with the acidifying agent 40 and the mercerized fibers 20 to produce the hemicellulose coated cellulose fibers 70 of the invention.

Referring to FIG. 4, the hemicellulose coated cellulose fibers 70 are formed into a highly porous paper product according to paper making methods known in the art. By way of example, the coated fibers 70 are washed 72 sufficiently to remove substantially all of any residual hemicaustic solution from the fibers, and the fibers, with or without other type of fiber mixed in, are dispersed on a paper forming wire 74. Water is drained from the fibers out of the bottom of the wire and may be recycled. As the fibers dry, they bond together into a thin web. The fiber web remaining on the wire is then squeezed between felt-covered press rollers 76 to remove more of the water.

The web is then passed through a series of heated metal cylinders 78, sometime referred to as Yankee rolls, to dry the paper. The drying and pressing processes cause the hemicellulose on the fiber surface to bond to each another, thereby forming stronger inter-fiber bonds. The stronger inter-fiber bonds of the paper reduce dusting of the paper by remaining intact even when the paper is bent or crimped. The web may then be passed through calendar rolls 80 to produce a porous paper sheet 82.

The paper making process may be used to make paper of various densities or porosities. For use to make filters, the high porosity pulp preferably has a porosity of above 100 $cm^3/(cm^2 \cdot s)$ of the Frazier Porosity Test. In general, paper made from the hemicellulose coated fibers of this invention exhibits improved strength compared to similarly prepared papers of standard high porosity pulps. The fibers and pulp of the invention are particularly suited for the formation of highly porous paper products.

EXAMPLES

Example 1

Mercerized Pulp

A fully bleached never-dried NaOH mercerized pulp with 50% moisture content was purchased as Porosanier™ pulp from Rayonier Inc., Jesup, Ga. The hemicellulose content of the pulp is about 2.5 wt %.

A first portion of the pulp was formed into a paper sheet, and the porosity of the paper was measured according to the Frazier test method, as known in the art. The measured porosity was 166 $cm^3/(cm^2 \cdot s)$, shown below in Table 1.

A second portion of the pulp was formed into a paper sheet, and the dusting of the paper was measured according to the Taber Wear Index method, as known in the art. The measured dusting value was about 17 mg/cycle.

Example 2

4% Hemicellulose Coated Pulp, Acidified First

A concentrated hemicaustic solution containing 20 g (oven-dried wt.) hemicellulose at room temperature was first acidified by sulfuric acid to pH 7, and then mixed with a pulp slurry containing about 500 g (oven-dried wt.) Porosanier™ pulp that resulted in a mixed pulp slurry having a 2% consistency. Note, the 20 g hemicellulose and 500 g pulp results in 4% on weight of hemicellulose addition. After mixing for about 15 minutes, the pulp was thoroughly washed with water.

A first portion of the pulp was formed into a 6 in diameter handsheet that was allowed to dry at room temperature until completely dry. About 52% of the added hemicellulose, measured by the increase in hemicellulose content in pulp, was adsorbed onto the fibers.

A second portion of the pulp was formed into a paper sheet, and the porosity of the paper was measured according to the Frazier test method, and the measured porosity was 171 $cm^3/(cm^2 \cdot s)$, shown below in Table 1.

A third portion of the pulp was formed into a paper sheet, and the dusting of the paper was measured according to the Taber Wear Index method, as known in the art. The measured dusting value was about 10.7 mg/cycle, a difference of −37% in comparison to the uncoated pulp, shown in Table 1.

Example 3-4%

Hemicellulose Coated Pulp, Acidified Last

A concentrated hemicaustic solution containing 20 g (oven-dried wt.) hemicellulose at room temperature was mixed with a pulp slurry containing about 500 g (oven-dried wt.) Porosanier™ pulp, resulting in a slurry of about 2% consistency. Thereafter, the resulting slurry was acidified by sulfuric acid to pH 7. After mixing for about 15 minutes, the pulp was thoroughly washed with water.

Paper sheets were formed and tested for hemicellulose content, porosity, and dusting as in Example 2, above. The comparative results are shown in Table 1.

TABLE 1

| | Example 1: Control pulp | Example 2: 4% Hemi acidified first | Example 3: 4% Hemi, mixed with pulp first |
|---|---|---|---|
| Hemicellulose uptake, % | 0 | 52% | 52% |
| Dusting Index Change, % | 0 | −37% | −60% |
| Porosity, $cm^3/(cm^2 \cdot s)$ | 166 | 171 | 167 |

As shown, the coated pulps of Examples 2 and 3 demonstrate substantially reduced dusting in comparison to the uncoated pulp. Surprisingly, the resulting porosity of the coated pulps is no less than the uncoated pulp. Thus, dusting has been dramatically improved with no decrease in porosity.

Example 4

Bleaching during Hemicellulose Deposition

About 5 kilograms of partially bleached Porosanier™ pulp was purchased from from Rayonier Inc., Jesup, Ga. Seven test samples, numbered 1 through 7, consecutively, of about 300 grams each, were separated out from the large sample. The samples were bleached by chlorine dioxide in laboratory bleaching equipment. The bleaching conditions were the same as that used in a typical bleaching operation, e.g. in the range of 50 to 80° C., 20 to 60 minutes, 2 to 15% consistency, and pH 3.0 to 4.5.

Of the seven bleaching tests, sample 1 had no hemicellulose addition, and the other six, samples 2-7, had different amount of hemicellulose addition, from 4% to 8% wt. on pulp, as that listed in row 2 of Table 2. For each of samples 2-7, the hemicellulose was first added to the pulp slurry, and then the other chemicals, namely sulfuric acid and chlorine dioxide, were added to the pulp slurry. After the bleaching, the pulp samples were thoroughly washed with water, and paper sheets were made for different tests as they were described in Example 2. The results are shown in Table 2.

TABLE 2

| | Control Sample 1 | Sample 2 | Sample 3 | Sample 4 | Sample 5 | Sample 6 | Sample 7 |
|---|---|---|---|---|---|---|---|
| Hemicellulose Added to Pulp, % | 0 | 8 | 7 | 5 | 4 | 4 | 4 |
| Hemicellulose uptake by Pulp, % | 0 | 44 | 45 | 48 | 47 | 52 | 50 |
| Dusting Reduction, % | 0 | 26 | 16 | 18 | 23 | 19 | 18 |
| Porosity, $cm^3/(cm^2 \cdot sec)$ | 172.4 | 181.0 | 174.2 | 170.8 | 175.4 | 180.4 | 180.6 |

As can be seen in row 3 of Table 2, about 50% of the added hemicellulose was adsorbed on to the fibers in all cases. The reduction of dusting, in present case, was in the range of 16% to 26%. Again, the porosity of the pulp was essentially unaffected, even when 3.5% of the hemicellulose was coated on the fibers.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An improved cellulosic pulp produced according to the steps of:

combining a pulp of mercerized cellulosic fibers, a hemicaustic solution, and an acidifying agent, thereby depositing hemicellulose as a coating onto the surface of the mercerized cellulosic pulp fibers, wherein the amount of hemicellulose on the surface of the fibers is present in the amount of about 0.1 wt % to 10 wt % per dry weight of the fiber.

2. The pulp of claim 1, wherein the coating is present in the amount of about 0.5 wt % to 10 wt % per dry weight of the fiber.

3. The pulp of claim 1 wherein the coating is present in the amount of about 0.5 wt % to 5 wt % per dry weight of the fiber.

4. The pulp of claim 1, wherein the mercerized cellulosic fibers are woody fibers.

5. The pulp of claim 1, wherein the pulp is provided as an aqueous slurry.

6. A paper sheet comprising mercerized cellulosic fibers coated with a hemicellulose coating, wherein the mercerized cellulosic fibers are produced according to the steps of combining a pulp of mercerized cellulosic fibers, a hemicaustic solution, and an acidifying agent thereby depositing hemicellulose as a coating onto the surface of the mercerized cellulosic pulp fibers;

wherein the amount of hemicellulose on the surface of the fibers is present in the amount of about 0.1 wt % to 10 wt % per dry weight of the fiber.

7. The paper sheet of claim 6, wherein the paper sheet has a porosity of greater than 100 $cm^3/(cm^2 \cdot s)$.

8. The paper sheet of claim 6, wherein the coating is present in the amount of about 0.5 wt % to 10 wt % per dry weight of the fiber.

9. The paper sheet of claim 6, wherein the coating is present in the amount of about 0.5 wt % to 5 wt % per dry weight of the fiber.

* * * * *